United States Patent [19]

Mickas

[11] 4,362,045

[45] Dec. 7, 1982

[54] TOOTH FORMING TOOLS

[75] Inventor: George Mickas, Southfield, Mich.

[73] Assignee: Ex-Cell-O Corporation, Troy, Mich.

[21] Appl. No.: 195,843

[22] Filed: Oct. 10, 1980

[51] Int. Cl.[3] ..... B21H 5/00

[52] U.S. Cl. ..... 72/469; 72/88

[58] Field of Search ..... 72/88, 90, 469

[56] References Cited

U.S. PATENT DOCUMENTS 3,902,349 9/1975 Miller ..... 72/469

4,016,738 4/1977 Puchko et al. ..... 72/469

*Primary Examiner*—Lowell A. Larson

*Attorney, Agent, or Firm*—Malcolm R. McKinnon

[57] ABSTRACT

Tools for pressure forming teeth on the periphery of a cylindrical workpiece, the tools having an improved tooth generating configuration which increases the effective rolling length of machines which have been and are presently being utilized to pressure form teeth on the periphery of cylindrical workpieces and which enables the pressure forming of many gears and other toothed parts which could not be pressure formed heretofore due to limitations in the length of tools that can be accommodated in such machines.

20 Claims, 11 Drawing Figures

TOOTH FORMING TOOLS

BRIEF SUMMARY F THE INVENTION

This invention relates to tools for pressure forming toothed elements and, more particularly, to improved tools for pressure forming teeth, such as spline teeth, gear teeth, worm teeth, serrations and the like on the periphery of cylindrical workpieces while the workpieces are at ambient or room temperature and without removal of material from the workpiece. Heretofore, various tools have been utilized commercially to pressure form spline teeth, gear teeth, worm teeth, and the like on the periphery of a cylindrical workpiece while the workpiece is at ambient or room temperature without removing material from the workpiece. Examples of prior art tools which have achieved commercial success in this field are disclosed in U.S. Pat. Nos. 2,994,237 and 3,015,243, such tools being utilized in machines of the type disclosed in U.S. Pat. No. 2,995,964.

An object of the present invention is to provide improved tooth forming tools which may be utilized in machines of the type disclosed in U.S. Pat. No. 2,995,964 and which increase the effective rolling length of such machines.

Another object of the present invention is to provide improved tools having an improved tooth generating configuration which enables the pressure forming of many gears and other toothed parts which could not be pressure formed heretofore due to limitations in the length of tools that can be accommodated in such machines.

Another object of the present invention is to provide improved tooth forming tools incorporating improved tooth generating means which improves the flow characteristics of the workpiece material during the process of generating teeth on the workpiece.

Another object of the present invention is to provide improved tools for pressure generating toothed elements which enable the quantity production of toothed elements with improved quality at reduced cost.

Still another object of the present invention is to provide improved tools for pressure generating toothed elements which tools have an improved tooth configuration that is economical and commercially feasible to manufacture, durable, efficient and reliable in operation.

The above as well as other objects and advantages of the present invention will become apparent from the following description, the appended claims and the accompanying drawings.

DETAILED DESCRIPTION

Figure 1:
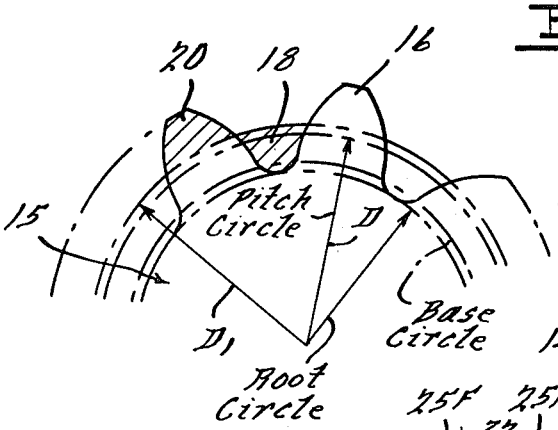
FIG. 1 is a schematic, perspective view, illustrating on an exaggerated scale, a pair of rack type tools embodying the present invention.

Referring to the drawings, a preferred embodiment of the invention comprises a specific tooth construction for a set of rack type tools, which set is generally designated 10, and which set is comprised of a pair of rack type tools, generally designated 12 and 14, which tools may be utilized in identical sets to pressure form involute spline teeth, involute gear teeth and the like, as well as other types of teeth on the periphery of a cylindrical workpiece. A machine in which two sets of rack type tools embodying the present invention may be utilized to pressure form a workpiece by metal displacement is described in detail in the aforementioned U.S. Pat. No. 2,995,964 although it will be understood that tools embodying the present invention may be utilized in other types of machines.

In general, a workpiece is positioned between upper and lower sets of tools embodying the present invention, the workpiece initially being positioned between the front or starting racks of the opposed sets of tools, and the tools are reciprocated in opposite directions across the workpiece to form a portion of the teeth on the periphery of the workpiece. The workpiece is then positioned between the rear or finishing racks of the opposed sets of tools, and the tools are again reciprocated in opposite directions across the workpiece to finish form teeth on the periphery of the workpiece. The workpiece is preferably supported by means which permit it to rotate freely about the longitudinal axis of the workpiece when urged to do so by the tools embodying the present invention. The tools 12 and 14 in each set 10 are provided with teeth, generally designated 25, on their working faces that engage the periphery of the workpiece and, in use, the tools are moved lengthwise by suitable means effective to move the tools simultaneously in opposite directions at the same velocity. The space between the working faces of the tools is less than the diameter of the workpiece with the result that the configuration of the working faces of the tools is impressed or conjugated on the periphery of the workpiece.

In forming teeth of the desired configuration on the periphery of the workpiece, the material from which the workpiece is made, (ordinarily steel) will flow adjacent the surface in radial and tangential directions so that there are grooves of less diameter than the original outside diameter of the workpiece and ridges of greater diameter than the original outside diameter of the workpiece. Since the final configuration of the workpiece must be accurately maintained, this flow of material should be taken into account in selecting the diameter of that portion of the workpiece which is subjected to the action of the tools embodying the present invention.

Figure 2:
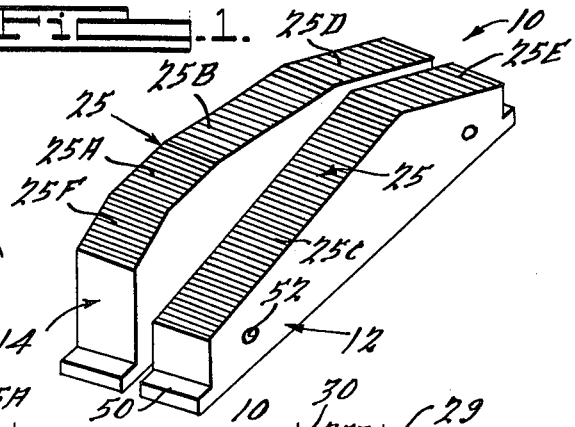
FIG. 2 is a fragmentary view of a typical involute spline that can be pressure formed by tools embodying the present invention.

To illustrate by consideration of a common but very important shape that may be rolled by tools embodying the present invention, there is shown in FIG. 2 a portion of a cross section of a workpiece 15 in finished form in which the workpiece has involute teeth or splines 16. Since no metal is removed in the cold rolling operation, the diameter of the workpiece prior to rolling cannot be either the final outside diameter or the root diameter. The rolling diameter $D_1$ of the workpiece 15 is selected so that the area 18 of removed tooth material below the $D_1$ periphery is equal to the area 20 of tooth material on a greater diameter than $D_1$. Diameter $D_1$, or substantially this diameter, defines the pitch line for rack type tools such as the tools 12 and 14. As will be described hereinafter in greater detail, the pressure angle or angle of obliquity of certain of the teeth of the tools 12 and 14 is the angle whose cosine is $D/D_1$ multiplied by the cosine of the pressure angle at the pitch diameter of the teeth 16 where D is the pitch diameter of the workpiece 15. The base pitch of the tools and the workpiece is identical. With such a construction, the linear pitch of the teeth on the tool, as measured on the pitch line thereof, corresponds with the circular pitch of the teeth on the workpiece, as measured on a circle having the diameter $D_1$ of the workpiece. The whole depth of at least some of the teeth on the tool 14 which engage the workpiece 15 is preferably the same as that of the workpiece, i.e., such tool teeth are fully conjugate to the teeth on the workpiece.

In use, a pair of tools 14 are spaced apart so that at a position near the trailing ends thereof, the working faces of the tools 14 provide a clearance equal to the root diameter of the workpiece 15 less a few thousandth of an inch to take up elasticity of the members and compression of oil films under rolling pressure. Only one pass of the tools 12 and one pass of the tools 14 in a reverse direction during the tooth forming operation is preferred.

In accordance with the present invention, the spacing between the working faces of a pair of tools 12 and the spacing between the working faces of a pair of tools 14 is regulated in a unique manner so that the depth of the impressions made in the workpiece increases at a controlled rate as the rolling operation proceeds. That is to say that the working faces of the tools approach closer together at a controlled rate toward the longitudinal axis of the workpiece as the length of the stroke increases. This "approach" may be regarded as a controlled feed of the tools into the workpiece as the tools move longitudinally relative to the workpiece. In accordance with the present invention, the convergence of the tool faces toward each other is accomplished by controlling the rate of penetration of successive sections of the teeth of the tools 12 and the teeth of the tools 14 toward each other by varying the rate of penetration of successive sections of the tool teeth into the workpiece while maintaining the pitch line of certain sections of the tool teeth constant, divergent sections of the teeth being provided at the trailing end of the tools 12, at the leading end of the tools 14 and at the trailing end of the tools 14 to provide relief at the end of the working stroke of the tools 12, at the beginning of the working stroke of the tools 14 and at the end of the working stroke of the tools 14.

Figure 5:
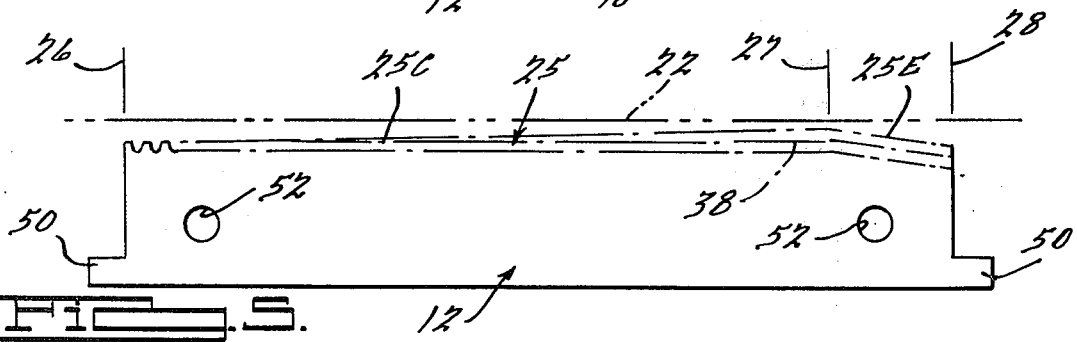
FIG. 5 is a side elevational view of the front or starting tool illustrated in FIG. 1.
Figure 8:
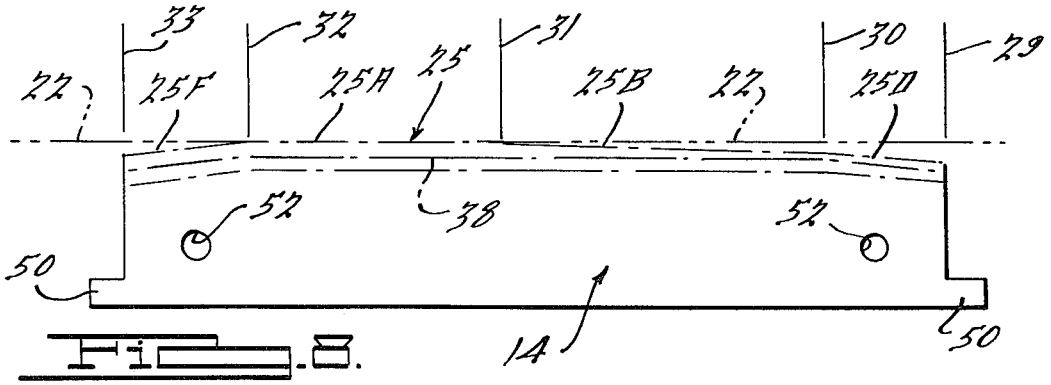
FIG. 8 is a side elevational view of the rear or finishing rack illustrated in FIG. 1.
Figure 9:
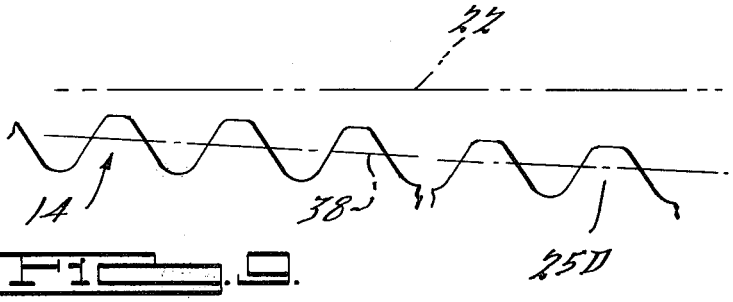
FIG. 9 is an enlarged elevational view of one section of the teeth of the tool illustrated in FIG. 8.
Figure 10:
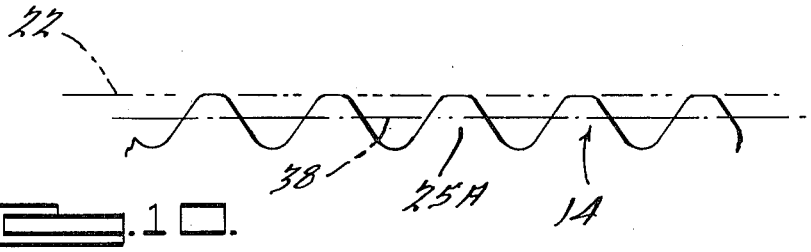
FIG. 10 is an enlarged elevational view of another section of the teeth of the tool illustrated in FIG. 8.
Figure 11:
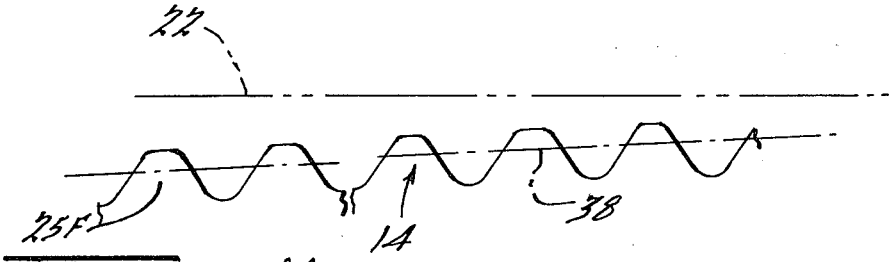
FIG. 11 is an enlarged view of still another section of the teeth of the tool illustrated in FIG. 8.

FIGS. 1 and 3 through 11 illustrate a set of tools 10, each set being comprised of a pair of racks 12 and 14 embodying the present invention, it being understood that the tooth formation of the mating set will be substantially identical. The numeral 22 designates a theoretical horizontal reference line which shows a "no taper" condition so that if the tops of the teeth on the tools 12 and 14 remained on the line 22, there would be no change in spacing between the working faces of the mating sets of tools as the tools moved relative to each other across the periphery of the workpiece. The teeth of the tools 12 and 14 are designated generally by the reference numeral 25 and, in the preferred embodiment of the invention illustrated, the teeth 25 are divided into six sections delineated by the reference lines 26, 27, 28, 29, 30, 31, 32, and 33, the reference lines 26 and 28 also delineating the leading end and the trailing end, respectively, of the tool 12 while the reference lines 29 and 33 delineate the leading end and the trailing end, respectively, of the tool 14. As shown in FIGS. 5 and 8, the pitch line 38 of the tool teeth 25 on the rack 12 is parallel to the reference line 22 from the leading end 26 of the tool 12 to the reference line 27, and the pitch line of the tool teeth 25 tapers downwardly away from the reference line 22 from the reference line 27 to the trailing end 28 of the tool 12. The pitch line of the tool teeth 25 on the tool 14 tapers downwardly away from the reference line 22 from the leading end 29 of the tool 14 to the reference line 30 and is co-planer with the pitch line of the tool teeth 25 on the tool 12 between the reference line 27 and the trailing end 28 of the tool 12. The pitch line of the teeth 25 on the tool 14 between the reference line 30 and the reference line 32 is parallel to the reference line 22, and the pitch line of the teeth 25 from the reference line 32 to the trailing end 33 of the tool 14 tapers downwardly away from the reference line 22. The tops of the tool teeth in the section on the rack 12 between the reference line 27 and the leading end 26 of the tool 12 taper downwardly toward the leading end 26 of the tool 12 while the pitch line of the teeth in the section of the tool 12 between the reference line 27 and the leading end 26 of the tool 12 remains parallel to the reference line 22. The tops of the teeth of the tool 14 in the section between the reference line 31 and the reference line 30 taper downwardly toward the reference line 30 while the pitch line of the teeth in the section of the tool 14 between the reference line 31 and the reference line 30 remains parallel to the reference line 22. In accordance with the teaching of U.S. Pat. No. 3,015,243, the teeth **25*a* between the reference lines 31 and 32 on the tool 14 are full sized and fully conjugate to the teeth to be formed on the workpiece and the pressure angle or angle of obliquity of the teeth 25*a* is the angle whose cosine is $D/D_1$ multiplied by the cosine of the pressure angle at the pitch diameter of the teeth to be formed on the workpiece where D is the pitch diameter of the teeth of the workpiece. The teeth 25*a* between the reference lines 31 and 32 conjugate the final form of the teeth on the workpiece. As previously mentioned, the pitch line of the teeth 25*f* between the reference line 32 and the trailing end 33 of the rack 14 tapers downwardly away from the reference line 22 and the teeth 25*f* between the reference line 32 and the trailing end 33**, while being substantially full sized, are also relieved on the sides or flank faces thereof. This relief eliminates seam lines or other errors that might otherwise be formed on the teeth of the workpiece at the end of the stroke due to the decreased total area of the contact between the tools and the workpieces as the rolling pressures are reduced at the end of the stroke.

The pitch line of all of the teeth on the tool 14 between the reference line 32 and the reference line 30, and the pitch line of all of the teeth on the tool 12 between the reference line 27 and the leading end 26 of the tool 12 is determined by the diameter $D_1$ of the workpiece in the manner previously described so that the linear pitch of the teeth on the tool, as measured on the pitch line thereof, corresponds with the circular pitch of the teeth on the workpiece as measured on a circle having the diameter $D_1$ of the workpiece. The pressure angle of all of the teeth between the reference line 32 and the reference line 30 on the tool 14, and the pressure angle of all of the teeth on the tool 12 between the reference line 27 and the leading end 26 of the tool 12 is the angle whose cosine is $D/D_1$ multiplied by the cosine of the pressure angle at the pitch diameter of the teeth on the workpiece where D is the conventional pitch diameter of the workpiece. The base pitch of the tools and the workpiece is identical. With such a construction, the linear pitch of the teeth on the tool as measured on the pitch line thereof, corresponds with the circular pitch of the teeth on the workpiece as measured on a circle having the diameter $D_1$ of the workpiece. The whole depth of the teeth 25*a* between the reference lines 31 and 32 on the tool 14 is preferably the same as that of the workpiece so that the teeth 25*a* are fully conjugate to the teeth on the workpiece.

Figure 6:
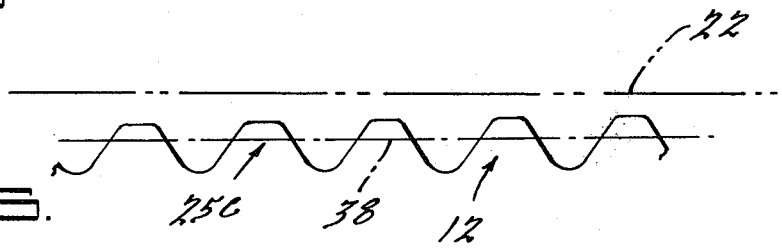
FIG. 6 is an enlarged elevational view of one section of the teeth of the tool illustrated in FIG. 5.
Figure 7:
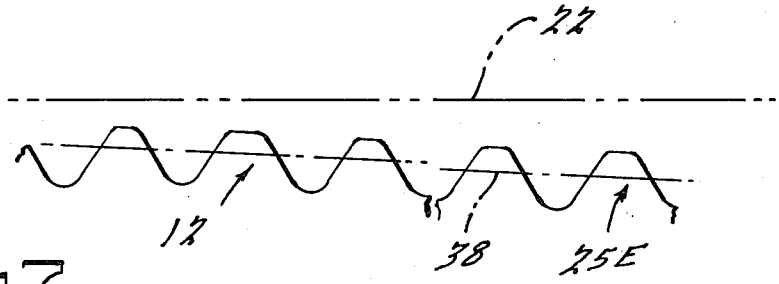
FIG. 7 is an enlarged view of another section of the teeth of the tool illustrated in FIG. 5.

In accordance with the present invention, the top lands of the teeth 25*b* on the tool 14 between the reference line 31 and the reference line 30, and the top lands of the teeth 25*c* on the tool 12 between the reference line 27 and the leading end 26 of the tool 12 are tapered downwardly while the pitch line of such teeth remains parallel to the reference line 22 as previously mentioned, the taper being provided by removing the theoretical addenda of the teeth as by grinding the teeth on a taper. The top land of the leading tooth 25*b* adjacent the reference line 30 is substantially the same height as the top land of trailing tooth 25*c* adjacent the reference line 27 while the top land of the leading tooth 25*c* adjacent the leading end 26 of the tool 12 may be located substantially at the pitch line 38 of the rack as shown, or may, for example, be disposed a half to a few thousandth of an inch above the pitch line. As shown in FIG. 6, the teeth 25*c* adjacent the leading end 26 of the rack 12 are relatively shallow, relatively wide and the leading edges have sharp corners as illustrated in FIG. 6, the sharp corners serving to grip the workpiece and initiate rotation thereof.

As shown in FIGS. 5, 7, 8 and 9, the pitch line of the teeth 25*e* between the reference line 27 and the trailing end 28 of the rack 12, and the pitch line of the teeth 25*d* between the reference line 30 and the leading end 29 of the rack 14 tapers downwardly away from the reference line 22, the teeth 25*d* and 25*e* being in alignment with each other when the racks 12 and 14 are mounted in the gear rolling machine in side by side relationship. The teeth 25*d* and 25*e* are also substantially full sized, and are also relieved on the sides or flank faces thereof as are the teeth 25*f* at the trailing end of the rack 14. The relief on the teeth 25*d* and 25*e* eliminates seam lines or other errors that might otherwise be formed on the teeth of the workpiece at the end of the stroke of the rack 12 and at the beginning of the stroke of the rack 14 due to the decreased total area of the contact between the tools and the workpiece as the rolling pressures are reduced at the end of the stroke of the rack 12 and as the rolling pressures are increased at the beginning of the stroke of the rack 14.

Figure 3:
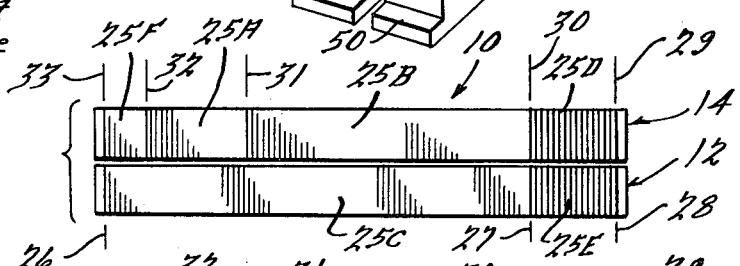
FIG. 3 is a diagrammatic top plan view of the teeth of the tools illustrated in FIG. 1.
Figure 4:
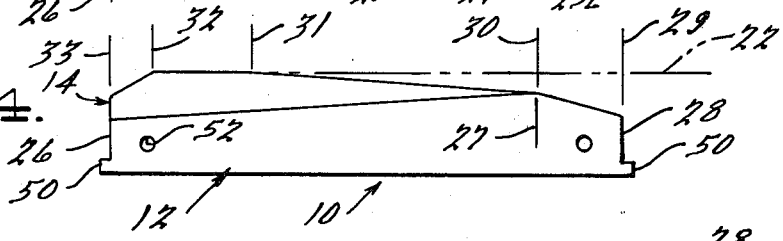
FIG. 4 is a diagrammatic side elevational view of the teeth of the tools illustrated in FIG. 1.

FIG. 3 illustrates a plan view of the teeth 25 when such teeth are intended to generate spur teeth on the workpiece. It will be noted that the tool teeth 25 are perpendicular to the sides of the tools 12 and 14, that is perpendicular to the direction of tool movement, but it will be understood that if the tools are to generate helical teeth on the workpiece, the tool teeth will be inclined to the sides of the tools or direction of tool movement.

In the preferred embodiment of the invention illustrated, the body portions of the tools 12 and 14 are illustrated as being provided with lugs such as 50 and transversely extending openings such as 52 which facilitate mounting the tools in machines of the type disclosed in U.S. Pat. No. 2,995,964, but it will be understood that other means may be utilized to mount the tools.

From the foregoing, it will be appreciated that with the above-described construction, the tools 12 and 14 increase the effective rolling length of machines of the type disclosed in U.S. Pat. No. 2,995,964, enable the pressure forming of many gears and other toothed parts which could not be pressure formed heretofore due to limitations in the length of tools which can be accommodated in machines of the type disclosed in U.S. Pat. No. 2,995,964, improve the flow characteristics of the workpiece material during the tooth generating process, improve the quality of the finished workpieces, and also reduce the cost of manufacture of the workpieces.

While a preferred embodiment of the invention has been illustrated and described, it will be understood that various changes and modifications may be made without departing from the spirit of the invention.

What is claimed is:

1. A set of tools for pressure forming teeth on the periphery of a cylindrical workpiece, said set being comprised of a pair of elongate racks each having a leading end and a trailing end and each being provided with a working face having a plurality of teeth thereon each having a pitch line, a first section of said teeth on one of said racks being disposed between said leading end and said trailing end of said one rack, each of said teeth in said first section having a configuration conjugate to the configuration of the teeth to be formed on the workpiece, said one rack having second and third sections of teeth disposed between said first section of teeth and said leading end of said one rack, the teeth in said second section having a pitch line parallel to the pitch line of the teeth in said first section, the tops of the teeth in said second section sloping toward said leading end of said one rack, the pitch line and the tops of the teeth in said third section sloping toward said leading end of said one rack, said one rack also having a fourth section of teeth disposed between said first section of teeth and said trailing end of said one rack, the pitch line and the tops of the teeth in said fourth section sloping toward said trailing end of said one rack, the other of said racks having fifth and sixth sections of teeth, the teeth in said fifth section having a pitch line parallel to the pitch line of the teeth in said first section, the tops of the teeth in said fifth section sloping toward the leading end of said other rack, the pitch line and the tops of the teeth in said sixth section sloping toward the trailing end of said other rack.

2. A set of tools as set forth in claim 1 wherein all of the teeth in said first, second and fifth sections have a common pitch line.

3. A set of tools as set forth in claim 1 wherein the tooth thickness of all of said teeth in said first, second and fifth sections are measured on the pitch line thereof is constant and wherein the interdental space between the teeth in said first, second and fifth sections as measured on the pitch line thereof is constant.

4. A set of tools as set forth in claim 1 wherein all of the teeth in said first, second and fifth sections have a linear pitch line.

5. A set of tools as set forth in claim 1 wherein the length of said fifth section is greater than the length of said second section.

6. A set of tools as set forth in claim 1 wherein said third and sixth sections of teeth are of equal length.

7. A set of tools as set forth in claim 1 wherein the teeth in said third and sixth sections are substantially identical and have a common pitch line.

8. A set of tools as set forth in claim 1 including means for fixing said racks in parallel relationship whereby the teeth in said third and sixth sections are disposed in aligned relationship.

9. A set of tools for pressure forming teeth on the periphery of a cylindrical workpiece, said set being comprised of a pair of elongate racks disposed in parallel relationship and each having a leading end and a trailing end, the leading end of one of said racks being disposed adjacent the trailing end of the other of said racks, each of said racks being provided with a working face having a plurality of teeth thereon each having a pitch line, a first section of teeth on said one rack being disposed between said leading end and said trailing end of said one rack, each of said teeth in said first section having a configuration conjugate to the configuration of the teeth to be formed on the workpiece and having a linear pitch line, said one rack having second and third sections of teeth disposed between said first section of teeth and said leading end of said one rack and a fourth section of teeth disposed between said first section of teeth and said trailing end of said one rack, the teeth in said second section having a linear pitch line aligned with the pitch line of the teeth in said first section, the tops of the teeth in said second section sloping toward said leading end of said one rack, the pitch line and the tops of the teeth in said third section sloping toward said leading end of said one rack, the pitch line and the tops of the teeth in said fourth section sloping toward said trailing end of said one rack, the other of said racks having fifth and sixth sections of teeth, the teeth in said fifth section having a linear pitch line coplanar with the pitch line of the teeth in said first and second sections, and the tops of the teeth in said fifth section sloping toward said leading end of said other rack, the tops of the teeth and the pitch line of the teeth in said sixth section sloping toward said trailing end of said other rack.

10. A set of tools as set forth in claim 9 wherein the tooth thickness of all of said teeth in said first, second and fifth section as measured on the pitch line thereof is constant and wherein the interdental space between the teeth in said first, second and fifth sections as measured on the pitch line thereof is constant.

11. A set of tools as set forth in claim 9 wherein the length of said fifth section is greater than the length of said second section.

12. A set of tools as set forth in claim 9 wherein said third and sixth sections of teeth are of equal length.

13. A set of tools as set forth in claim 9 wherein the teeth in said third and sixth sections are substantially identical and the pitch lines thereof are aligned in side by side relationship.

14. A set of tools as set forth in claim 9 including means for fixing said racks in parallel relationship whereby the teeth in said third and sixth sections are disposed in aligned relationship.

15. A set of tools for pressure forming teeth on the periphery of a cylindrical workpiece, said set being comprised of a pair of elongate racks disposed in parallel relationship, each of said racks having a leading end and a trailing end, the leading end of one of said racks being disposed adjacent the trailing end of the other of said racks, each of said racks being provided with a working face having a plurality of teeth thereon each having a pitch line, a first section of teeth on said one rack being disposed between said leading end and said trailing end of said one rack and being fully conjugate to the teeth to be formed on the workpiece and having a horizontal pitch line, said one rack having second and third sections of teeth disposed between said first section of teeth and said leading end of said one rack, the addenda of said second section of teeth successively decreasing in height with respect to the height of the addenda of the teeth in said first section, the teeth in said second section having a horizontal pitch line, the tops of the teeth and the pitch line of the teeth in said third section sloping toward said leading end of said one rack, said one rack also including a fourth section of teeth, the tops of the teeth and the pitch line of the teeth in said fourth section sloping toward said trailing end of said one rack, the other of said racks having fifth and sixth sections of teeth, the teeth in said fifth section having a horizontal pitch line and the addenda of the teeth in said fifth section successively decreasing in height with respect to the height of the addenda of the teeth in said second section and sloping toward said leading end of said other rack, the tops of the teeth and the pitch line of the teeth in said sixth section sloping toward the trailing end of said other rack.

16. A set of tools as set forth in claim 15 wherein the tooth thickness of all of said teeth in said first, second and fifth sections as measured on the pitch line thereof is constant and wherein the interdental space between the teeth in said first, second and fifth sections as measured on the pitch line thereof is constant.

17. A set of tools as set forth in claim 16 wherein the length of said fifth section is greater than the length of said second section.

18. A set of tools as set forth in claim 17 wherein said third and sixth sections of teeth are of equal length.

19. A set of tools as set forth in claim 18 wherein the teeth in said third and sixth sections are substantially identical.

20. A set of tools as set forth in claim 19 including means for fixing said racks in parallel relationship whereby the teeth in said third and sixth sections are disposed in aligned relationship.

* * * * *